US011988384B2

(12) United States Patent
Giacomelli

(10) Patent No.: US 11,988,384 B2
(45) Date of Patent: May 21, 2024

(54) DEVICE FOR CONTROLLING THE SUPPLY OF A COMBUSTIBLE GAS TO A BURNER OF A HEATING APPARATUS

(71) Applicant: SIT S.P.A., Padua (IT)

(72) Inventor: Massimo Giacomelli, Venice (IT)

(73) Assignee: SIT S.P.A., Padua (IT)

( * ) Notice: Subject to any disclaimer, the term of this patent is extended or adjusted under 35 U.S.C. 154(b) by 430 days.

(21) Appl. No.: 17/296,681

(22) PCT Filed: Nov. 25, 2019

(86) PCT No.: PCT/EP2019/082343

§ 371 (c)(1),
(2) Date: May 25, 2021

(87) PCT Pub. No.: WO2020/109196

PCT Pub. Date: Jun. 4, 2020

(65) Prior Publication Data

US 2022/0026065 A1 Jan. 27, 2022

(30) Foreign Application Priority Data

Nov. 26, 2018 (IT) ..... 102018000010571

(51) Int. Cl.
*F23N 1/00* (2006.01)
*F23K 5/00* (2006.01)

(52) U.S. Cl.
CPC ..... *F23N 1/005* (2013.01); *F23K 5/007* (2013.01); *F23K 2900/05002* (2013.01);
(Continued)

(58) Field of Classification Search
CPC .. F23N 1/005; F23N 2235/16; F23N 2235/20; F23N 2235/24; F23K 5/007; F23K 2900/05002
(Continued)

(56) References Cited

U.S. PATENT DOCUMENTS 3,402,887 A 9/1968 Visos
3,915,378 A * 10/1975 Kinsella ..... G05B 9/00 236/99 R
(Continued)

FOREIGN PATENT DOCUMENTS

EP 1058060 A1 12/2000
EP 2270396 A2 1/2011

*Primary Examiner* — Avinash A Savani
(74) *Attorney, Agent, or Firm* — Volpe Koenig

(57) ABSTRACT

A device for controlling a combustible gas supply to a heating apparatus burner includes:

a valve with a respective valve seat which is associated with a corresponding closure member provided with a respective control rod for opening the valve seat, a system for amplifying movement of the control rod which has a snap-fit spring which acts on the rod and a pushing element which in turn acts on the spring, a first end of a lever acts on the pushing element which is hinged at a fulcrum location which is positioned at an opposing second end of the lever, actuator which moves the lever, operationally associated with the lever in a position between the opposing lever ends to control the lever about the fulcrum location resulting in movement of the closure member away from and towards the valve seat, the actuator comprising a linear actuator element with converse piezoelectric effect.

8 Claims, 2 Drawing Sheets

(52) U.S. Cl.
CPC ..... *F23N 2235/16* (2020.01); *F23N 2235/20* (2020.01); *F23N 2235/24* (2020.01)

(58) Field of Classification Search
USPC ..... 431/18
See application file for complete search history.

(56) References Cited

U.S. PATENT DOCUMENTS

| | | | | |
|---|---|---|---|---|
| 4,975,043 | A | 12/1990 | Katchka et al. | |
| 2005/0081920 | A1* | 4/2005 | Rimondo ..... | F23N 1/007 137/487.5 |

* cited by examiner

DEVICE FOR CONTROLLING THE SUPPLY OF A COMBUSTIBLE GAS TO A BURNER OF A HEATING APPARATUS

TECHNICAL FIELD

The present invention relates to a device for controlling the supply of a combustible gas to a burner of a heating apparatus according to the features set out in the preamble of main claim 1.

Technological Background

The invention particularly, though not exclusively, involves the sector of devices for controlling the supply of combustible gases in units with valves which are provided for uses in heating apparatuses, for example, heating apparatuses for sanitary water and apparatuses for heating environments. Typically, these known devices provide for the combustible gas to be supplied through a valve group which is provided with a magnetic safety unit with a pilot and thermocouple, which is arranged upstream of a main supply valve for directly or indirectly controlling (servo-assisted system) a gas circuit towards a main burner.

The opening/closing control of the main valve is constructed with thermostat devices, which are typically of a thermomechanical type and which are suitable for acting on the control of the supply valve in accordance with the preselected heating temperature.

For example, in a water heating apparatus of known type, including a pilot valve in a servo-assisted circuit of the main valve, the movement of the pilot valve in accordance with the heating requirement is directly controlled by a mechanical thermostat, for example, produced by a bi-metal sensor with differential expansion which is immersed in the water storage tank.

For greater efficiency of movement of actuation on the closure member of the valve, it is further known to provide a system for amplifying the travel of the closure member, comprising a lever mechanism which is associated with a snap-fit spring (for example, constructed with a spring of the "Belleville" type) which acts on the closure member so as to ensure the opening/closing movement of the pilot valve in accordance with small movements of the thermostat which are correlated with the expansion of a thermal type.

One of the main limitations which can be identified in such a device involves the reduced precision which can be obtained during control of the temperature and which is influenced by phenomena of lack of calibration which recur in these thermostats of the thermomechanical type.

Another limitation is associated with the fact that with such a device there cannot be provided algorithms for adjusting the temperature, with exclusively ON/OFF differentials being able to be produced.

As an alternative to using thermomechanical thermostats, the use of electrical operators during control of the valves, for example, which are constructed with actuators with electromagnets in conjunction with temperature sensors which are suitable for controlling the operating instruction of the electromagnet, generally involves energy consumption levels which are not compatible with the energy values which can be obtained with thermoelectric generators which are internal with respect to the device, for example, of the so-called "thermopile" type, in which the electrical energy for controlling the device is produced exclusively by the thermoelectric generator (supplied by the flame of the pilot burner).

With such consumption levels, therefore, it is necessary to use an electrical supply by the electrical network, which, in addition to making the device more complex, makes it less versatile in all the applications in which it is undesirable to depend on the electrical network for the operation of the heating apparatus.

STATEMENT OF INVENTION

A main object of the present invention is to provide a device for controlling the supply of a combustible gas to a burner of a heating apparatus, which is structurally and operationally configured to overcome the limitations indicated above with reference to the cited prior art.

This object and other objects which will be clearly appreciated below are achieved by the invention by means of a device for controlling the supply of a combustible gas to a burner of a heating apparatus, which is constructed in accordance with the appended claims.

BRIEF DESCRIPTION OF THE DRAWINGS

Additional features and advantages of the invention will be better appreciated from the following detailed description of a number of preferred embodiments thereof which are illustrated by way of non-limiting example with reference to the appended Figures, in which.

PREFERRED EMBODIMENTS OF THE INVENTION

Figure 1:
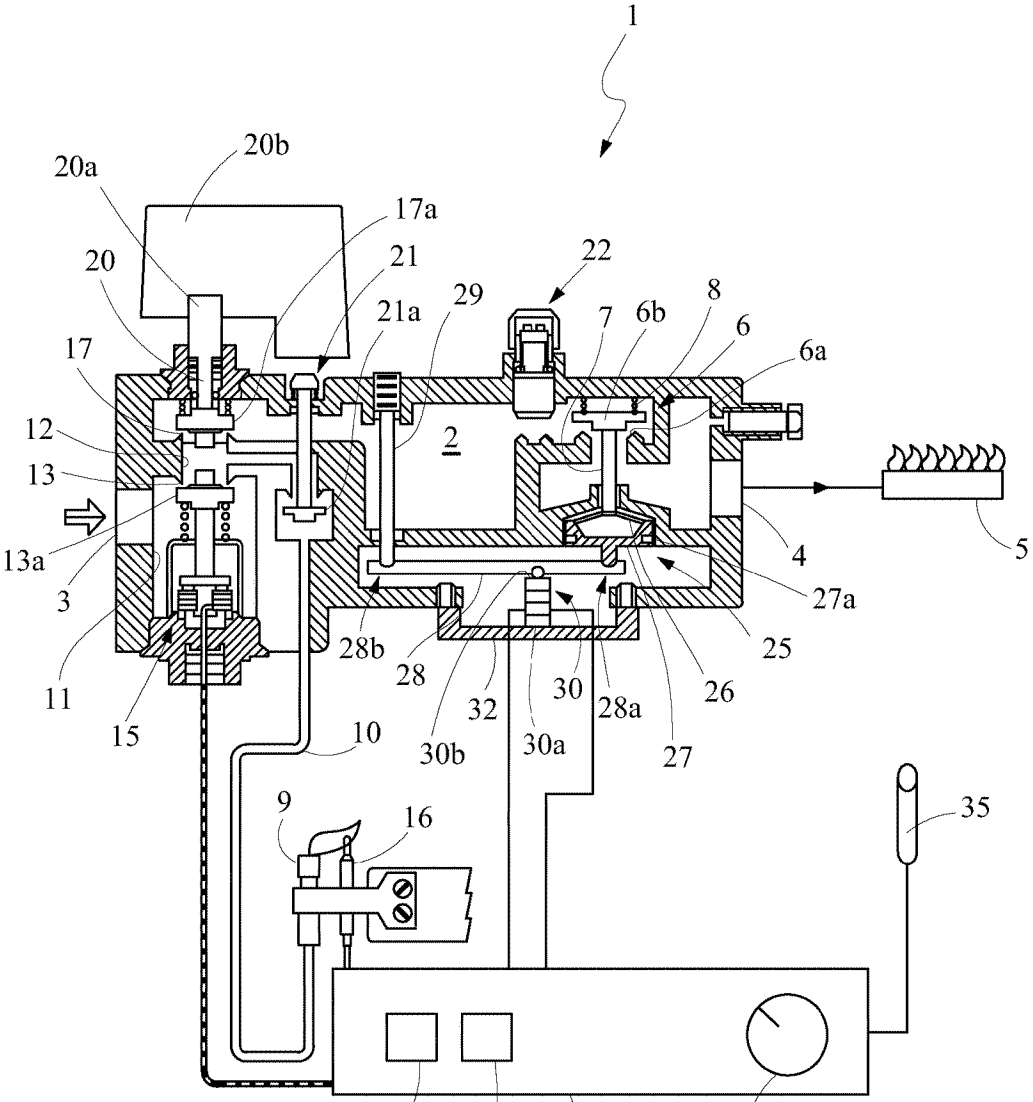
FIG. 1 is a schematic longitudinal section of a first example of the control device according to the invention.

Initially with reference to FIG. 1, which is provided as a general view of the schematic type, there is generally designated 1 a device for controlling the supply of a combustible gas to a burner of a heating apparatus, which is constructed in accordance with the present invention.

It will be understood that the device according to the invention may equally be used both in heating apparatuses for sanitary water (water heaters) and in apparatuses for heating environments, whether they are heaters for heating water flowing in a heating circuit for environments, they are fireplaces or similar apparatuses which are dedicated to directly heating an environment.

The device 1 comprises a valve group which is arranged in a pipe 2 for supplying gas between an inlet section 3 of the gas and an outlet section 4, wherein the gas is supplied to a main burner 5.

There is provided along the pipe 2 a valve, which is generally designated 6. The valve 6 comprises a valve seat **6*a* which is associated with a corresponding closure member 6*b* which is provided with a control rod 7 for opening the seat 6*a* counter to a respective resilient return means, such as a respective spring 8**.

The valve 6 performs the function of an on/off valve for opening/closing the main gas route along the pipe 2, as will be clearly appreciated from the description below.

The valve group of the device further comprises an auxiliary gas line which is branched off from the pipe 2 with which a pilot burner 9 is supplied. The auxiliary line provides for a pilot pipe 10 which branches off from the pipe 2 in order to supply the pilot burner.

From the inlet section 3, there are defined in the pipe 2 a first portion 11 which extends into a second portion 12 through an interposed valve seat 13, on which a closure member 13*a* of a thermoelectrical magnetic safety unit 15 acts with a manual activation, including the closure member 13*a*, which is retained in the opening position of the valve seat 13 by the excitation of the magnetic group which is generated by the electric voltage correlated with the energy produced by a thermoelectric generator 16, for example, a thermopile or thermocouple, which is associated with the flame of the pilot burner 9. For the sake of simplicity, reference will be made herein below to the thermoelectric generator using the term "thermopile".

There is provided near the pilot burner 9 a flame ignition element which is not illustrated and which is conventional per se.

The second portion 12 of the main pipe 2 extends between the valve seat 13 and an additional valve seat 17 which cooperates with a respective closure member 17*a*. The closure member 17*a* is mounted on an actuator rod 20 of the manual activation member, which has a push-button 20*a*, of the magnetic safety unit 15. Advantageously, the rod 20 is constructed in two portions which extend in a mutual axial extent.

The pilot pipe 10 branches off from the second portion 12 of the pipe 2 which remains between the valve seats 13 and 17 so that, during the ignition step of the pilot burner 9, with the movement of the manual activation actuator rod 20, the closure member 13*a* is moved so as to open the valve seat 13 and the closure member 17*a* is moved so as to close the valve seat 17 in order to selectively allow the passage of gas exclusively along the pilot pipe 10 in order to supply the main burner 9, preventing the flow of gas from reaching the main valve 6.

The valve seats 13, 17 are advantageously arranged with the respective closure members coaxial relative to each other in an axial direction in which the movement of the rod 20 of the manual activation member of the magnetic group is brought about.

There is designated 20*b* a control handle for the valve group which can take up three positions, specifically an "OFF" position, a "PILOT" position and an "ON" position.

There is designated 21 a safety pilot valve which has a closure member 21*a* and which is open when the handle 20*b* is placed in the "PILOT" position, while this valve is closed with the handle in the "OFF" position and remains open with the handle in the "ON" position.

With specific reference to the handle 20*b*, in the "OFF" position the valve seat 17 is open, the valve seat 13 is closed and the valve seat associated with the closure member 21*a* is closed too.

In the "PILOT" position, the closure member 21*a* is moved so as to open the respective valve seat. By means of the push-button 20*a* (which may be integral with the handle 20*b* or separate therefrom, in this second case the user has to rotate the handle and at the same time press the push-button), the closure member 17*a* is moved so as to close the valve seat 17 and the closure member 13*a* is moved so as to open the seat 13.

In the "ON" position, the valve seat associated with the closure member 21*a* remains open. If the push-button is integral with the handle, in this position the closure member is moved so as to open the valve seat 17, if the push-button is separate from the handle, it is simply necessary to release the push-button in order to maintain the valve seat 17 in the open state.

There is further designated 22 a throttle device of the preset or settable type, which is arranged in the main pipe upstream of the valve 6 and which is capable of regulating the flow of gas present in this pipe portion. For controlling the closure member 6*b*, there are provided actuator means which are generally designated 25 and which are described in detail below, and which act on the control rod 7 of the closure member by means of a system for amplifying the travel of the rod 7 for moving the closure member 6*b* so as to open/close the valve seat 6*a*.

The amplification system comprises a snap-fit spring 26 which is, for example, constructed with a spring of the "Belleville" type, and which is capable of taking up two separate configurations in opposite directions in accordance with the load applied to the spring, one of these configurations being shown in FIG. 1. The snap-fit spring 26 acts centrally on the free end of the control rod 7 of the closure member and is urged peripherally by a pushing element 27 which is guided in a sliding manner in a respective seat 27*a* coaxially with the rod 7 and the snap-fit spring 26. Therefore, the pushing element acts on the spring 26 in order to activate in terms of snap-fit movement the spring which is capable of producing the amplification of the linear travel of the closure member. In other words, from a first configuration of the spring until reaching a first load threshold which is applied to the spring itself, the spring is moved in a snap-fit manner, taking up a second configuration, with amplification of the movement (which is reflected in the travel of the closure member for opening the valve). Following the reduction of the load applied, when a second lower load threshold is reached, the spring snap-fits into the first configuration, amplifying, in the opposite direction, the closure travel of the closure member on the valve seat.

By applying the load to the pushing element 27, there is provided a lever structure 28 which carries ends 28*a*, 28*b* which are axially opposite in the longitudinal extent direction of the lever.

The lever acts with the end 28*a* thereof on the pushing element 27 while it is hinged at the opposite end 28*b* by means of the contact with a calibration screw 29. The position of the fulcrum can be adjusted by screwing/unscrewing the calibration screw, as illustrated in FIG. 1.

The actuation means 25 comprise a linear actuator element 30 with a converse piezoelectric effect, in which the linear movement of the actuator is proportionally correlated with the signal of an electric control voltage which is applied to the actuator.

Figure 2:
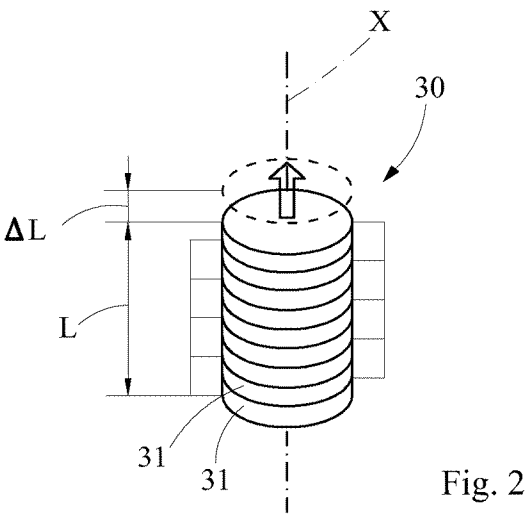
FIG. 2 is a schematic perspective view, to an enlarged scale, of a detail of the device of the invention.

The actuator element 30 is operationally associated with the lever 28 in a position between the ends 28*a*, 28*b* for the control of the lever during a pivoting movement about the fulcrum location so as to obtain the resultant movement of the closure member 6*b* away from and towards the valve seat 6*a* by means of the amplification system of the above-described movement. The piezoelectric actuator 30 advantageously comprises a multi-layered structure which is formed by a plurality of single piezoelectric actuator members 31 (which are electrically connected to each other) which are of a suitable shape (for example, disc-like) and which are arranged in a group one on the other with a suitable sequence of relative polarity, in an axial stacking direction which is designated X. FIG. 2 schematically shows, drawn to an enlarged scale, an example of a piezoelectric actuator of the above-mentioned type.

There is designated L the length in an axial direction of the group of piezoelectric members 31 of the actuator, in a deactivated state. There is designated ΔL the dimension of extension (with a broken line) of the actuator in the axial direction when it is electrically supplied.

The actuator element 30 is in abutment with a stationary structure 32 of the device in the region of an end portion 30*a* thereof, having the opposite portion of the axial end 30*b* (in the direction X) in the region of the lever 28 for operationally controlling it.

There is designated 33 an electronic control unit, which is only schematically illustrated and which is constructed as a printed circuit board including the circuit complex (microprocessor) which is suitable for performing the functionalities provided for by the control logic implemented in the device. The printed circuit board is electrically supplied by the energy produced by the thermoelectric generator 16.

In the Figures, the printed circuit board from which the control unit 33 is constructed is shown in a state interfaced with the valve group by means of electrical connections which are depicted with solid lines.

There is designated 34 a selector (for example, with a handle) for programming the preselected temperature which is intended to be reached in the fluid heated by the apparatus. A temperature sensor 35, which is provided to detect the temperature of the fluid, is connected to the control unit for transmitting the signal corresponding to the temperature level measured.

There are further provided in the control unit circuit means for carrying out the comparison (of the respective signals) between the temperature programmed with the selector and the temperature measured by the sensor, and to generate a control signal for the piezoelectric actuator in order to open/close the valve 6 in accordance with the required operating condition, that is to say, in order to achieve/maintain the selected temperature level. There is provided in the unit 33 a first electric voltage increasing unit 37 which is suitable for increasing the voltage generated by the thermoelectric generator 16 up to the useful voltage level for efficiently supplying the printed circuit board from which the unit 33 is produced for the correct operation thereof.

In order to electrically supply the piezoelectric actuator 30, there is provided in the electronic unit 33 a second electric voltage increasing unit 36 which is suitable for increasing the voltage, with which the unit is supplied up to the voltage necessary for obtaining, by means of the converse piezoelectric effect, the movement of the actuator 30.

Merely by way of non-limiting example, the voltage for correctly supplying the printed circuit board may be 3.3 volt (obtained at the outlet from the first voltage increasing unit) while the useful voltage for controlling the piezoelectric actuator may be up to values of 200 volt (obtained at the outlet from the second voltage increasing unit).

In the example described above, with reference to the device illustrated in FIG. 1, the valve 6, whose opening/closing is controlled by the piezoelectric actuator 30, is configured as a main valve in the gas supply pipe 2, from which the gas is supplied directly to the main burner of the heating apparatus.

During operation, upon a request for ignition of the burner 5, there is first carried out the activation of the magnetic safety unit by pressing, with the relevant push-button, the control rod 20, bringing about the opening of the valve seat 13 and the simultaneous closure of the valve seat 17 so as to allow the gas flow to be produced exclusively along the pilot pipe 10. At the same time as the passage of gas into the pilot pipe, the ignition of the pilot burner 9 is brought about. In this condition, the gas flow towards the main burner is intercepted by the closure member 17*a* which closes the valve seat 17.

Once the activation of the group has been carried out with the relevant electromagnet being excited by means of the electric voltage correlated with the voltage generated by the thermopile which is heated by the flame at the pilot burner 9, following the correct ignition thereof the device is prepared to carry out the ignition of the main burner 5, on the basis of the temperature request programmed with the selector 34. In this position, the valve 6 is further intercepted and the control unit 33 is ready to receive the ignition signal of the main burner by means of a preselected programmable position with the selector 34.

If this programming (heat request) requires the ignition of the main burner (in accordance with the comparison carried out between the preselected temperature and the temperature measured by the sensor), the control unit sends an instruction signal (electric voltage) to the piezoelectric actuator 30, with which the valve 6 is opened, releasing the gas passage directly towards the main burner.

In this operating step, the ignition and the extinguishing of the main burner are controlled by the temperature signal which is sent by the sensor 35 to the control unit 33 and on the basis of which the control signal of the piezoelectric actuator is or is not generated.

In other words, any time the temperature measured by the sensor is less than the temperature level programmed with the selector, the activation of the piezoelectric actuator brings about the movement of the closure member 6*b* (by means of the movement of the snap-fit spring 26 into the configuration which allows opening of the valve 6) in order to open the main valve. When the desired temperature level is reached, the resultant deactivation of the piezoelectric actuator 30 reduces the load acting on the snap-fit spring 26 until the condition is reached in which the spring 26 is snap-fitted into the configuration suitable for allowing the valve seat 6*a* to be closed, with a resultant extinguishing of the main burner 5.

In other words, when the temperature has reached the programmed temperature level (set point), there is applied to the actuator an electric voltage of zero so as to cause the spring 26 to be snap-fitted into the closure configuration of the valve seat 6*a*. The electric supply voltage of the piezoelectric actuator varies only between two states, that is to say, between a state in which it is equal to a few hundred volt (for example, 200 volt) in order to cause the spring to take up the configuration which allows the valve seat 6*a* to be opened, and a state in which it is equal to 0 volt, which is suitable for allowing the seat 6*a* to be closed.

Figure 3:
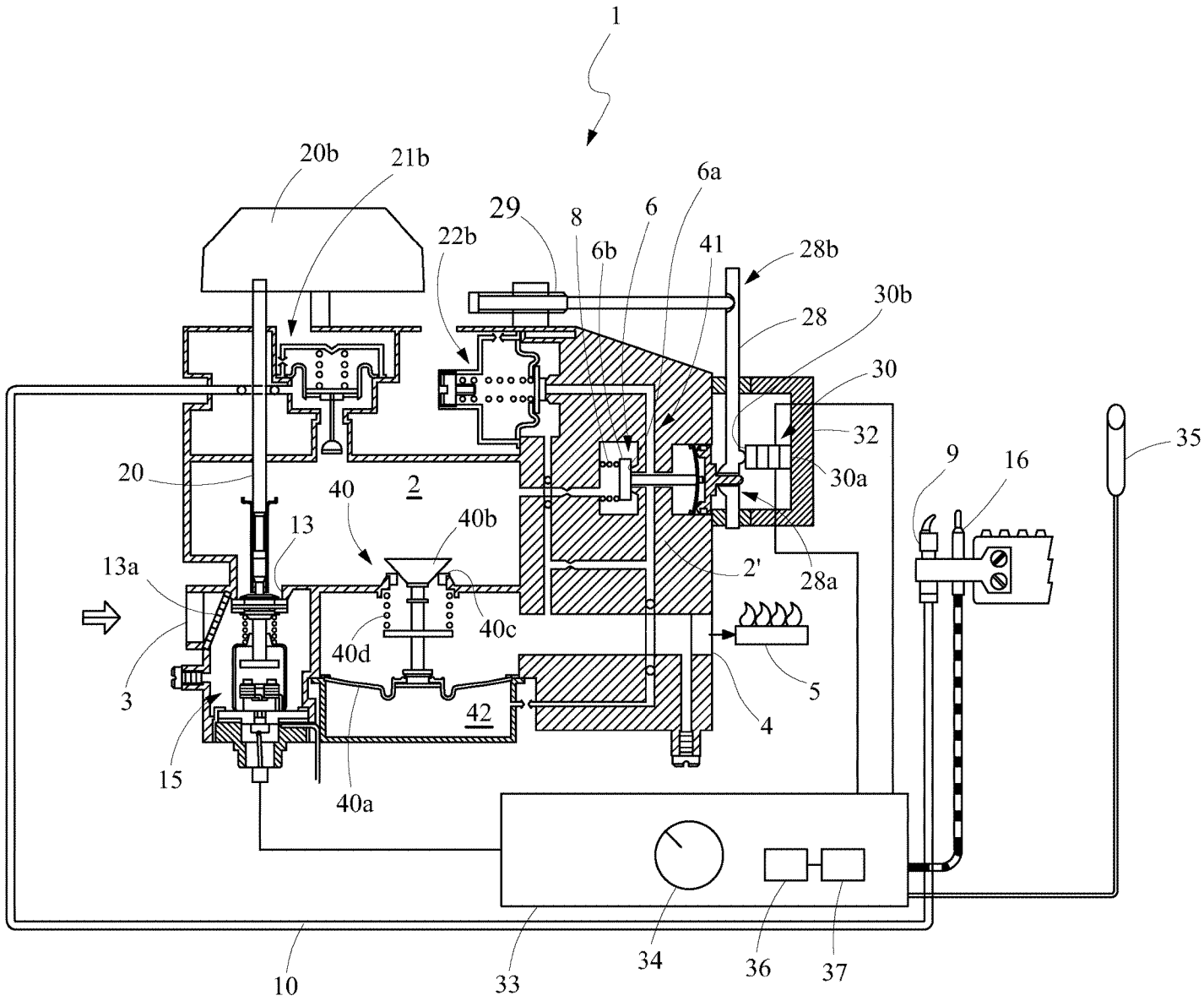
FIG. 3 is a view corresponding to that of FIG. 1 of a second example of a control device according to the invention.

With reference to a second example of the device of the invention, which is shown in the schematic drawing of FIG. 3 and which is generally designated 1', there is provision for the valve 6 which is controlled by the piezoelectric actuator 30 to be configured as an auxiliary valve of servo-assistance for controlling a separate main valve which is designated 40 and has membrane type control 40*a* and which is capable of supplying the gas to the burner of the heating apparatus.

The valve 40 comprises a closure member 40*b* which is associated with a corresponding valve seat 40*c*, with a spring 40*d* for the resilient return of the closure member 40*b* so as to close the seat.

In this example, wherein details similar to those of the example of FIG. 1 are indicated with the same reference numerals, the servo-valve 6 is provided in a servo-assistance circuit 41 and the corresponding valve seat 6*a* (with a respective closure member 6*b*) is provided on an auxiliary pilot pipe 2' of the servo-circuit 41, which constitutes the intake pipe for the pressure signal to be transferred to a pilot chamber 42.

One side of the membrane 40*a* partially delimits the pilot chamber 42, which is in communication with the auxiliary pipe 2', and the membrane 40*a* acts on the closure member 40*b*, which is in turn urged so as to close the seat by the spring 40*d*.

There is further provided on the auxiliary pipe 2' a membrane type pressure regulator 22*b* of the preset or settable type which is configured to react to and to compensate for the supply pressure variations and to bring the pressure to a predetermined set value by means of adjustment of a corresponding setting spring.

The pressure in the circuit of the pilot pipe 10 is controlled by a pressure regulator 21*b* in a manner independent of the regulation of the pressure present in the pipe 2, where the main valve 40 acts.

During operation, there is provision for the commutation of the handle 20*b* between the "OFF", "PILOT" and "ON" positions in a manner similar to what has been described in the preceding example. Upon a request for the burner to be ignited, the activation of the magnetic safety unit is first carried out by pressing, with the relevant push-button, on the control rod 20, bringing about the opening of the valve seat 13 so as to allow the gas flow to be produced along the pilot pipe 10.

At the same time as the gas passage in the pilot pipe, the ignition of the pilot burner 9 is brought about. In this condition, the gas flow towards the main burner is intercepted by the closure member 40*b* of the main valve. Once the activation of the group has been carried out with the relevant electromagnet being excited by means of the electric voltage which is correlated with the voltage generated by the thermopile which is heated by the flame at the pilot burner 9, following the correct ignition thereof the device is prepared to carry out the ignition of the main burner, on the basis of the temperature request which is programmed with the selector 34. In this position, the main valve is further intercepted and the control unit 33 is ready to receive the ignition signal of the main burner by means of a preselected position which can be programmed with the selector 34.

If this programming requires the ignition of the main burner (in accordance with the comparison carried out between the preselected temperature and the temperature measured by the sensor), the control unit sends an instruction signal to the piezoelectric actuator, with which the valve 6 of the servo-assistance circuit is opened so that there is generated in the pilot chamber 42 a corresponding pressure which is suitable for bringing about a movement of the membrane 40*a* which tends to urge the respective closure member 40*b* from the seat 40*c*, releasing the gas passage from the valve 40 towards the main burner.

In this operating step, the ignition or the extinguishing of the main burner are controlled by the temperature signal which is sent by the sensor 35 to the control unit 33 and on the basis of which the control signal of the piezoelectric actuator is or is not generated.

In other words, any time the temperature measured by the sensor is less than the temperature level programmed with the selector, the activation of the piezoelectric actuator brings about the movement of the snap-fit spring into the configuration which allows opening of the valve 6 so as to bring the pressure signal in the pilot chamber in order to open the main valve. When the desired temperature level is reached, the resultant deactivation of the piezoelectric actuator reduces the load acting on the snap-fit spring until the condition is reached in which the spring is snap-fitted into the configuration suitable for allowing the valve seat 6*a* to be closed, with a resultant closure of the main valve.

The invention thereby achieves the objects set out while achieving a number of advantages with respect to the known solutions.

A first advantage involves the fact that the provision of an actuator with a converse piezoelectric effect for controlling the valve of the device involves reduced energy consumption levels with respect to operators or actuators of other types which are used in the known solutions.

The reduced energy consumption levels which are required by the piezoelectric actuator advantageously allow the production of control devices in heating apparatuses which can effectively be supplied by the energy produced by thermoelectric generators (thermopiles) or batteries, therefore without any need for a connection to the electrical network.

Another advantage is that the use of piezoelectric actuators in a control device according to the invention prevents the use of thermo-mechanical actuators which are subjected to phenomena of lack of calibration which reduce the reliability and the precision in terms of the control of the temperature in the heating apparatus.

The invention claimed is:

1. A device for controlling the supply of a combustible gas to a burner of a heating apparatus, the device comprising:

a pipe (2) for supplying the gas which extends between an inlet section (3) and an outlet section (4), at least one valve (6) including a respective valve seat (6*a*) which is associated with a corresponding closure member (6*b*) which is provided with a respective control rod (7) for opening the valve seat counter to a resilient return means (8), a system for amplifying the movement of the control rod (7) of the closure member, the system comprising a snap-fit spring (26) which acts on the rod (7) and a pushing element (27) which in turn acts on the snap-fit spring (26) in order to activate a snap-fit movement of the spring, the pushing element (27) being acted upon by a first end (28*a*) of a lever (28), which is hinged at a fulcrum location which is positioned at an opposing second end (28*b*) of the lever, an actuator operationally associated with the lever in a position between the opposing ends (28*a*, 28*b*) for control of the lever during a pivoting movement about the fulcrum location for a resultant movement of the closure member (6*b*) away from and towards the valve seat (6*a*) by the amplification system, the actuator comprising a linear actuator element (30) with a converse piezoelectric effect, in which a linear movement of the actuator is proportionally correlated with a signal of an electric control voltage which is applied to the actuator; and a sensor (35) configured to detect temperature and an electronic control unit (33) of the device, to which a signal detected by the sensor (35) is transmitted, the electronic control unit further comprising a comparator, which compares the temperature signal detected with a preselected and selectable temperature level in the control unit (33), and a control signal generator of the piezoelectric actuator (30) in order to open/close the at least one valve (6) in order to reach the selected temperature level.

2. The device according to claim 1, wherein the actuator element (30) comprises a multi-layered structure with a plurality of single piezoelectric elements (31) which are arranged in a group one on the other with a suitable sequence of relative polarity, in an axial direction (X).

3. The device according to claim 2, wherein the actuator element (30) is in abutment with a stationary structure (32) of the device in a region of a first end portion (30*a*) thereof, having a second opposing end portion (30*b*) in the axial direction (X) in the region of the lever structure (28) for operational control thereof.

4. The device according to claim 1, wherein the at least one valve (6) is configured as a main valve in the supply pipe (2), via which the gas is directly supplied to the burner of the heating apparatus.

5. The device according to claim 1, wherein the at least one valve (6) is configured as an auxiliary valve of a servo-assistance circuit for controlling a different and separate main valve (40) with membrane type control (40*a*) which is capable of supplying the gas to the burner of the heating apparatus.

6. The device according to claim 1, further comprising a thermoelectric generator (16) which is supplied by the flame present in a pilot burner which is associated with the main burner of the heating apparatus, energy of the thermoelectric generator (16) electrically supplying the control unit (33), the control unit comprising an electric voltage increasing unit (36) in order to generate a voltage suitable for controlling the piezoelectric actuator (30).

7. A heating apparatus comprising a burner and a device for controlling the supply of a combustible gas to the burner according claim 1.

8. A device for controlling the supply of a combustible gas to a burner of a heating apparatus, the device comprising:

a pipe (2) for supplying the gas which extends between an inlet section (3) and an outlet section (4), at least one valve (6) including a respective valve seat (6*a*) which is associated with a corresponding closure member (6*b*) which is provided with a respective control rod (7) for opening the valve seat counter to a resilient return means (8), a system for amplifying the movement of the control rod (7) of the closure member, the system comprising a snap-fit spring (26) which acts on the rod (7) and a pushing element (27) which in turn acts on the snap-fit spring (26) in order to activate a snap-fit movement of the spring, the pushing element (27) being acted upon by a first end (28*a*) of a lever (28), which is hinged at a fulcrum location which is positioned at an opposing second end (28*b*) of the lever, an actuator operationally associated with the lever in a position between the opposing ends (28*a*, 28*b*) for control of the lever during a pivoting movement about the fulcrum location for a resultant movement of the closure member (6*b*) away from and towards the valve seat (6*a*) by the amplification system, the actuator comprising a linear actuator element (30) with a converse piezoelectric effect, in which a linear movement of the actuator is proportionally correlated with a signal of an electric control voltage which is applied to the actuator, wherein the actuator element (30) comprises a multi-layered structure with a plurality of single piezoelectric elements (31) which are arranged in a group one on the other with a suitable sequence of relative polarity, in an axial direction (X).

* * * * *